US010532381B2

(12) United States Patent
Stewart et al.

(10) Patent No.: US 10,532,381 B2
(45) Date of Patent: Jan. 14, 2020

(54) APPARATUS, SYSTEM AND METHOD FOR FLOWING A FLUID THROUGH A TROUGH

(71) Applicant: M-I L.L.C., Houston, TX (US)

(72) Inventors: Colin Stewart, Houston, TX (US); Zakhar Chizhov, Houston, TX (US); Mazin Philip, Houston, TX (US); Mandeep Singh Ahuja, Houston, TX (US); Richard Bingham, Katy, TX (US)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 15/528,077

(22) PCT Filed: Nov. 24, 2015

(86) PCT No.: PCT/US2015/062245

§ 371 (c)(1),
(2) Date: May 18, 2017

(87) PCT Pub. No.: WO2016/085891

PCT Pub. Date: Jun. 2, 2016

(65) Prior Publication Data

US 2017/0320099 A1 Nov. 9, 2017

Related U.S. Application Data

(60) Provisional application No. 62/085,042, filed on Nov. 26, 2014.

(51) Int. Cl.
*B07B 13/16* (2006.01)
*E21B 21/06* (2006.01)

(52) U.S. Cl.
CPC ..... *B07B 13/16* (2013.01); *E21B 21/065* (2013.01); *B07B 2201/04* (2013.01); *B07B 2230/01* (2013.01)

(58) Field of Classification Search
CPC .. B07B 1/38; B07B 1/46; B07B 13/16; B07B 2201/04; B07B 11/06; E21B 21/065
(Continued)

(56) References Cited

U.S. PATENT DOCUMENTS 7,527,153 B2 * 5/2009 Lease ..... B07B 1/12 209/314
2007/0170099 A1 7/2007 Stolworthy
(Continued)

OTHER PUBLICATIONS

International Search Report and Written Opinion for PCT/US2015/062245 dated Mar. 8, 2016.
(Continued)

*Primary Examiner* — Charles A Fox
*Assistant Examiner* — Kalyanavenkateshware Kumar
(74) *Attorney, Agent, or Firm* — Jeffrey D. Fantz

(57) ABSTRACT

A method, apparatus and system for flowing a fluid from an inlet flush nozzle onto tiered plates in a trough is provided. Material may fall from a deck in a vibratory separator, such as a shale shaker, into the trough, which is attached to the separator. The trough has a main inlet and the inlet flush nozzle that opens to tiered plates. An external pipe may feed the fluid into the main inlet and the inlet flush nozzle to lubricate the tiered plates in the trough. Material falling from the vibratory separator may float on the fluid to flow toward an outlet of the trough. A single plate with perforations may be used instead of the tiered plates to permit the fluid to penetrate the perforations to suspend the material, allowing the material to flow across the single plate to an outlet.

16 Claims, 14 Drawing Sheets

(58) Field of Classification Search
USPC ..... 209/17, 233, 311, 314, 315, 320, 354
See application file for complete search history.

(56) References Cited

U.S. PATENT DOCUMENTS

| | | | | |
|---|---|---|---|---|
| 2010/0270216 | A1 | 10/2010 | Burnett et al. | |
| 2011/0297373 | A1 | 12/2011 | Timmerman et al. | |
| 2013/0233776 | A1 | 9/2013 | Berkhout et al. | |
| 2013/0277284 | A1 | 10/2013 | Jones et al. | |
| 2016/0144377 | A1* | 5/2016 | Lomond ..... | B07B 13/16 209/17 |

OTHER PUBLICATIONS

International Preliminary Report on Patentability for PCT/US2015/062245 dated Jun. 8, 2017.

* cited by examiner

APPARATUS, SYSTEM AND METHOD FOR FLOWING A FLUID THROUGH A TROUGH

CROSS-REFERENCE TO RELATED APPLICATIONS

This application claims benefit of U.S. patent application Ser. No. 62/085,042, filed Nov. 26, 2014, the entire disclosure of which is herein incorporated by reference.

BACKGROUND

Separators are used in various industries to separate components of a mixture. For example, separators can be used to separate solid components from a mixture or liquids from a solid-liquid mixture. Vibratory separators use vibrational energy to separate components. Vibratory separators are used in various industries.

In the oil and gas industry, for example, vibratory separators called "shale shakers" are used to separate solids from liquids in oil-based and/or water-based drilling fluids, referred to as "mud." For example, such separators may include sifting and/or filtering screens to remove solids from a slurry. Drill cuttings from used drilling mud may flow onto mesh screens of the shale shaker. Vibrational energy applied to the shale shaker may shake the mesh screens to separate the drill cuttings from the used drilling much to clean the mud for further use in drilling operations.

Mud serves multiple purposes in the industry. Drilling mud acts as a lubricant to cool rotary drill bits and facilitate faster cutting rates. Further, dispersion of the drilling mud around a drill bit, for example, may assist in counterbalancing various pressures encountered in subterranean formations. Various weighting and lubrication agents are mixed into the drilling mud to obtain the correct mixture for the type and construction of the formation to be drilled. Because the mud evaluation and/or the mixture process may be time consuming and expensive, drillers and service companies prefer to reclaim and reuse drilling mud. Another purpose of the drilling mud is to carry rocks and/or cuttings from the drill bit to the surface. For example, in a wellbore, the cuttings and/or solids may enter into the drilling mud and must be removed before the drilling mud may be reused.

Recently, drilling fluids containing bridging materials, also known in the art as wellbore strengthening materials or loss prevention materials, have seen increased use in drilling operations where natural fractures in the wellbore allow drilling fluid to escape from the circulating system. Wellbore strengthening materials are typically mixed into the drilling fluid and used to bridge the fractures to prevent fluid loss into the formation. Such wellbore strengthening materials are also used in stress cage drilling, which involves intentionally creating fractures in the wellbore and bridging the fractures with the materials. Such applications create a hoop stress and stabilize the formation. Wellbore strengthening materials typically are more expensive than other additives used in drilling fluid components. Thus, drillers benefit when wellbore strengthening materials are recovered during waste remediation.

Accordingly, collection and movement materials from a separator, whether oilfield or non-oilfield related, is generally beneficial to the industry.

BRIEF DESCRIPTION OF DRAWINGS

The foregoing and other features of the present disclosure will become more fully apparent from the following description, taken in conjunction with the accompanying drawings. Understanding that these drawings depict only several embodiments in accordance with the disclosure and are therefore, not to be considered limiting of its scope, the disclosure will be described with additional specificity and detail through use of the accompanying drawings.

DETAILED DESCRIPTION

While some of the example embodiments utilize a vibratory separator in the oilfield industry as an example, the invention should not be deemed as limited to the vibratory separator or the oilfield industry. A person of ordinary skill in the art will appreciate that the embodiments of the disclosure are applicable to other types of separators and other vibratory separators outside of the oilfield industry. The inventors herein contemplate the use of the embodiments disclosed herein in many fields, including industrial screening applications.

In the following detailed description, reference is made to accompanying figures, which form a part hereof. In the figures, similar symbols or identifiers typically identify similar components, unless context dictates otherwise. The illustrative embodiments described herein are not meant to be limiting. Other embodiments may be utilized, and other changes may be made, without departing from the spirit or scope of the subject matter presented here. It will be readily understood that the aspects of the present disclosure, as generally described herein, and illustrated in the figures, may be arranged, substituted, combined and designed in a wide variety of different configurations, which are explicitly contemplated and form part of this disclosure.

Vibratory separators may use filtration screens to separate solids from fluids and to separate solids of different sizes. For example, shakers may use filtration screens to separate drill cuttings from drilling fluid in on-shore and off-shore oilfield drilling. The separating screens may have a mesh stretched across a frame. The mesh may allow particles and/or fluid below a predetermined size to pass through the separating screen. The separating screen is vibrated while the mixture of particles and/or fluids may be deposited on an input side. The vibration may improve separation and may convey the remaining particles to a discharge end of the separating screen.

Figure 1:
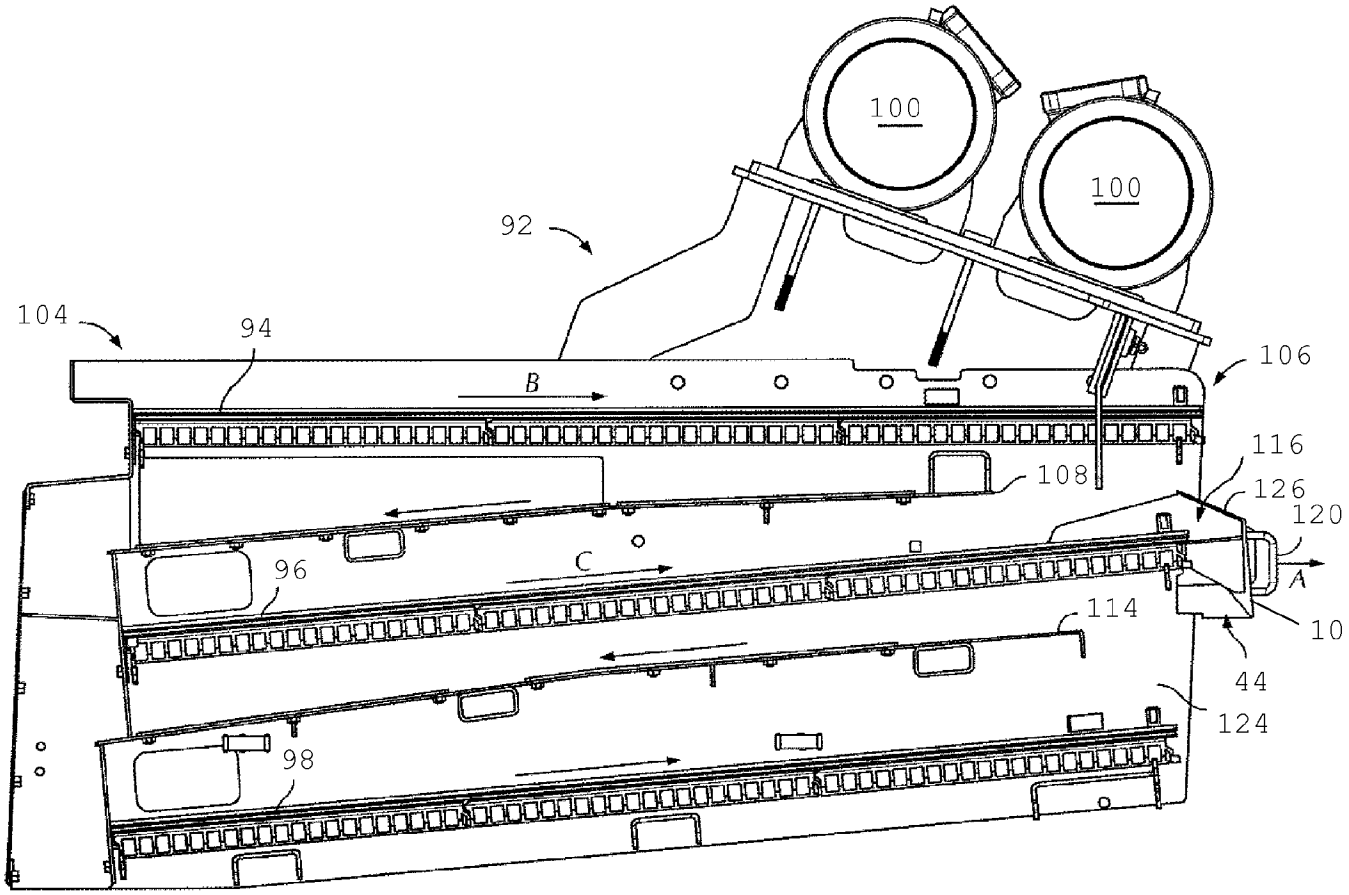
FIG. 1 is a cross-section view of a vibratory separator according to embodiments of the present disclosure.

Referring now to FIG. 1, a cross-section plan view of a vibratory separator having a collection trough 10 according to embodiments of the present disclosure is shown. In an embodiment, vibratory separator 92 includes three decks 94, 96, and 98, wherein top deck 94 may be a scalping deck, a middle deck 96 may be a second cut deck, and a bottom deck 98 may be a fines deck. Vibratory separator 92 may also include two motion actuators 100 that may be configured to provide a motion to decks 94, 96, and 98 during operation of the vibratory separator 92. As illustrated, the collection trough 10 may be in fluid communication with middle deck 96. The collection trough 10 may be formed from various materials, such as steel, and may have various coatings to prevent corrosion during operation of the vibratory separator 92.

Each deck 94, 96, and 98 may include one or more screens (not independently illustrated). The screens include a plurality of perforations of a particular size, thereby allowing fluids and solids entrained therein that may be smaller than the size of the perforations to flow through the screens, while particular matter larger than the screen may be retained on top of the screen for further processing. Those of ordinary skill in the art will appreciate that the screens on each of decks 94, 96, and 98 may have perforations with different sizes, such that the over flow (e.g., the retained solids) from each screen may be of different sizes. In such an embodiment, the retained solids from deck 94 may be of a larger size than the retained solids from decks 96 and 98. Thus, by selecting different perforation size for screens on decks 94, 96, and 98, a specific solid size from each deck may be retained. Those of ordinary skill in the art will appreciate that depending on the requirements of a reparatory operation, one or more of the screens on decks 94, 96, and/or 98 may also have screens with perforations of the same and/or substantially the same size.

As drilling fluid containing particulate matter (e.g., a slurry) may enter the vibratory separator 92 though an inlet side 104 where the slurry may flows in a direction B, such that fluid and undersized particles form an underflow (i.e., fluids and particulate matter that passes through screens), pass through a screen on first deck 94 and into a first flowback pan 108. The overflow (e.g., drill cuttings or large solids) that did not pass through the screen(s) on first deck 94 may then be discharged from first deck 94 at large particulate discharge point 106. The underflow may then flow down the first flowback pan 108 and onto deck 96. The mesh used on screens of the deck 96 may be selected such that a predetermined material size or material, such as wellbore strengthening materials, may be retained on screen 96. Thus, fluids and particulate matter smaller than the perforations in the screen(s) on deck 96 may fall through a screen of the middle deck 96 and onto second flowback pan 114, while wellbore strengthening materials are retained on the screen(s) and moved in direction C.

The vibratory separator 92 may also have a collection trough 10 coupled to at least one of the decks 94, 96, or 98 of vibratory separator 92. The collection trough 10 may be, for example, removably coupled or permanently coupled to the vibratory separator 92. In an embodiment, the collection trough 10 is illustrated coupled to middle deck 96. As shown, the collection trough 10 may be configured to receive a flow of solid overflow from the second deck 96, which may include solids that may be too large to fit through perforations in a screen on second deck 96. It will be appreciated by those having ordinary skill in the art that the solids may contain liquid material, such as drilling fluid, wellbore fluid, hydrocarbons, water or other fluids. In certain aspects, the solids that are collected in collection trough 10 may include wellbore strengthening materials, such as fluid wellbore strengthening materials that are designed to lower the volume of filtrate that passes through a filter medium and into the formation. Other solids, such as drill cuttings may be entrenched or otherwise conveyed from the vibratory separator 92 with the wellbore strengthening material. Examples of wellbore strengthening materials, including lost circulation material ("LCM") that may include sized-salts, sized-calcium carbonates, polymers, sand, mica, nutshells (e.g, ground peanut shells and walnut shells), plant fibers, cottonseed hulls, ground rubber, and other wellbore strengthening materials known in the art.

The collection trough 10, in this aspect, may have an inlet 116 that may be configured to receive an overflow from the second deck 96 and an outlet 44 (shown in FIG. 2) configured to direct the overflow to, for example, a storage vessel or an active drilling fluid system. The drilling fluid system may have drilling fluid tanks, mixing tanks, or other containers located at the drilling site, where drilling fluids are mixed and stored prior to use during drilling. Handles 120 may be attached to a side of the collection trough 10 to allow, for example, an operator to remove, to divert the materials from the collection trough 10 when either wellbore strengthening materials are not used or when collection of the wellbore strengthening materials is not necessary. In certain aspects, it may be desirable for the reparatory operation to continue without the collection of wellbore strengthening materials. In such an operation, the operator may simply remove the collection trough 10 from second deck 96 by sliding collection trough 10 in direction A. In an embodiment, the collection trough 10 may be secured to second deck through mechanical attachment points (not shown), such as bolts or screws, while in other aspects, the collection trough 10 may be secured to deck 96 through a pneumatic actuation system, such as pneumatic systems typically used to secure screens to decks.

Those of ordinary skill in the art will appreciate that the collection trough 10 may be disposed on and/or associated with one or more of the other decks, such as first deck 94 and/or third deck 98 in certain separatory operations. For example, in a return flow of drilling fluid with high solids content, it may be beneficial to collect wellbore strengthening materials from the third deck 98, while in other operations, it may be beneficial to collect wellbore strengthening materials from the first deck 94. In still other aspects, the collection trough 10 may be used on more than one deck to collect multiple sized wellbore strengthening materials. Further, the location of the collection trough 10 may be selected based on the perforation size of the screens of a particular deck and/or based on the size of the wellbore strengthening materials being collected.

Fluids and particulate matter that may be smaller than a perforation size of a screen on deck 96 may not enter collection trough 10. Rather, the fluids and fine particulate matter may pass through the screen on middle deck 96 onto flowback pan 114. In a final separatory action, fluids and particulate matter smaller than a screen on deck 98 may flow through the screen into a reservoir or sump in vibratory separator 92 that may be in fluid communication with the active drilling fluid system. Fines that may be larger than the perforation on screens disposed on the bottom deck 98 may be discharged from the vibratory separator at discharge point 124 for disposal thereafter.

In certain applications, the vibratory separator 92 may be a flow-through vibratory separator as shown in FIG. 1, and may be modified by, for example, providing for a bypass of one or more of the decks 94, 96, and/or 98. Additionally, series and/or parallel flow may be achieved by, for example, diverting a flow of fluid around one or more of decks 94, 96, 98, or away from one or more of flow back pans 108 and/or 114.

Figure 3:
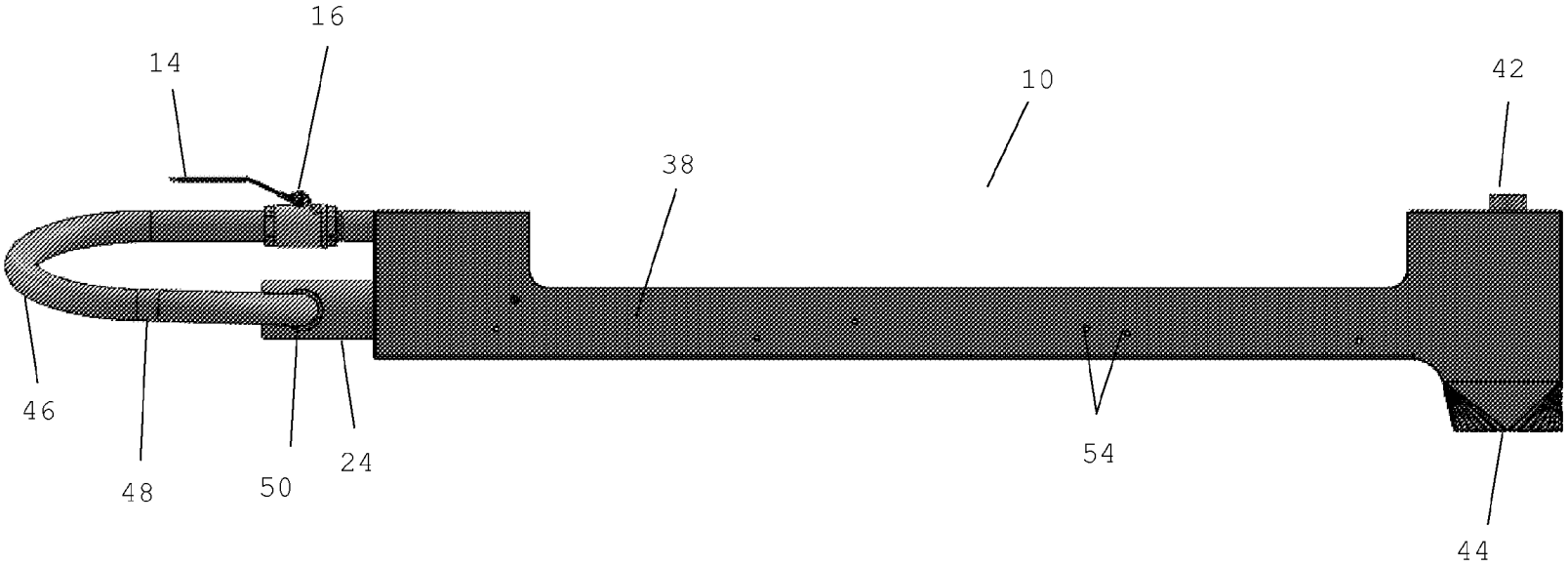
FIG. 3 illustrates a front view of the trough in accordance with embodiments disclosed herein.
Figure 4:
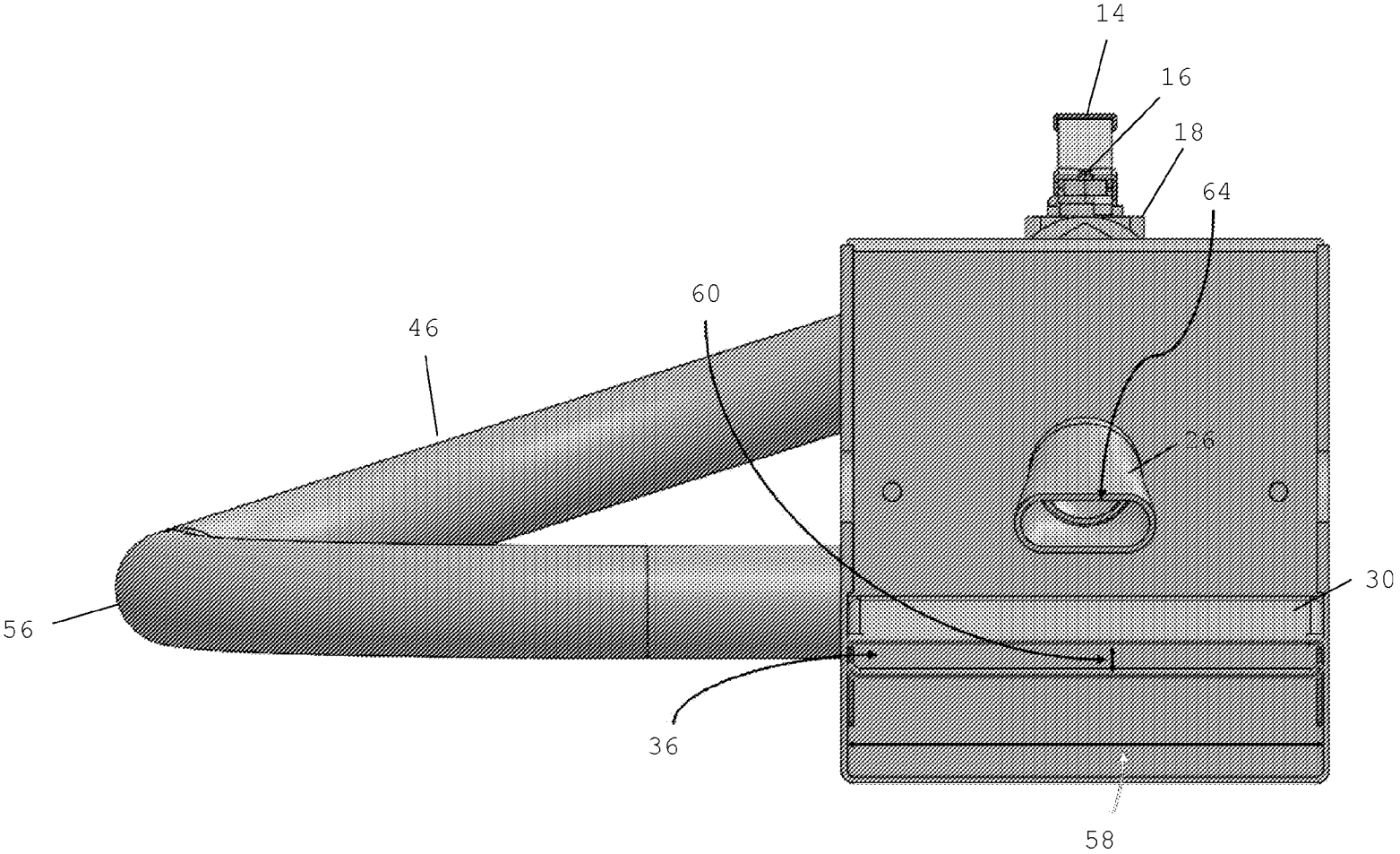
FIG. 4 illustrates a side section view of the trough depicting the fluid film nozzle in accordance with embodiments disclosed herein.
Figure 5:
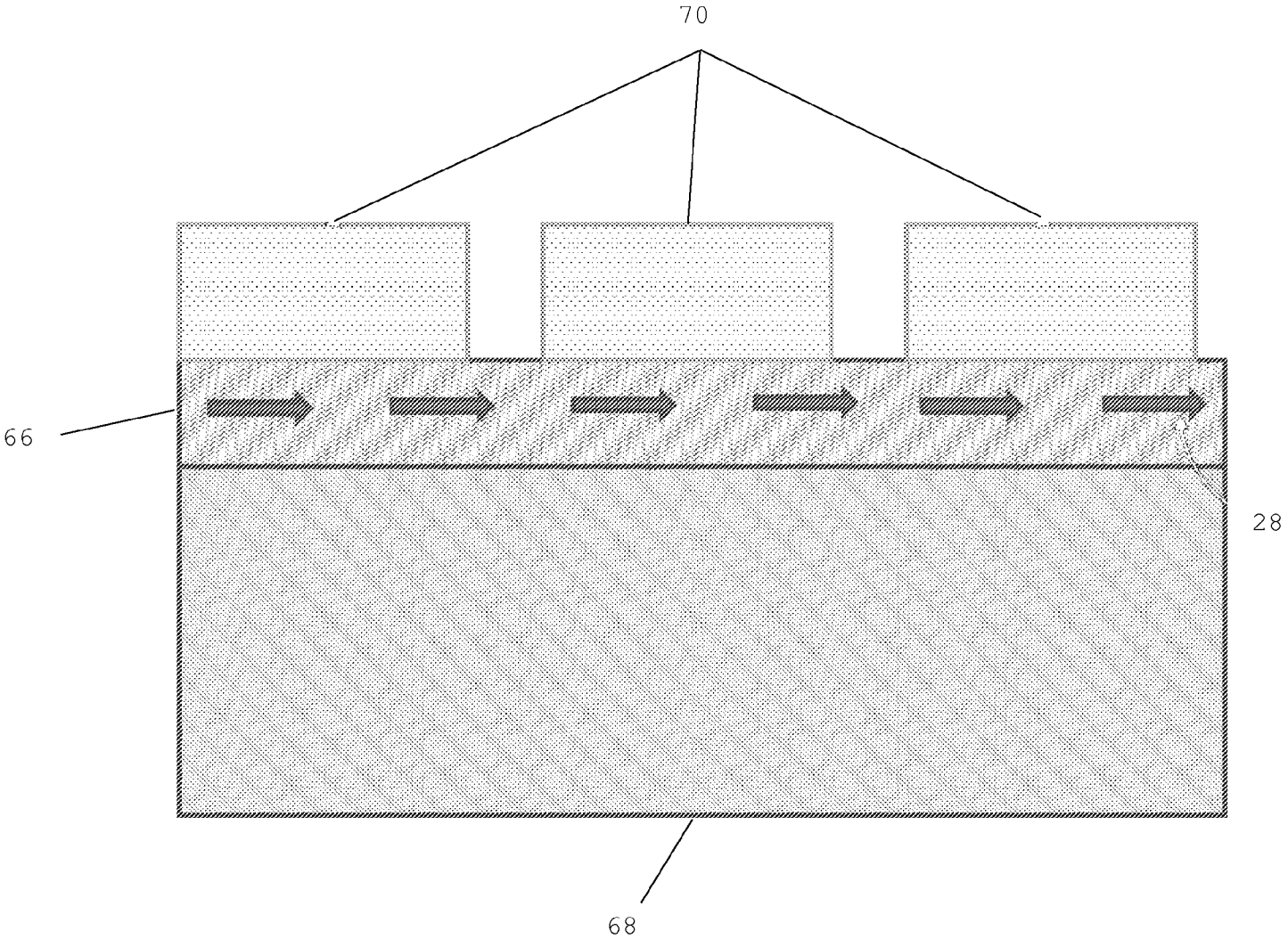
FIG. 5 illustrates a schematic diagram depicting material flow in accordance with embodiments disclosed herein.

Now referring generally to FIGS. 2 through 7, a trough 10 may be configured to flow a mixture of material 70, as shown in, for example, FIG. 5, in accordance with the embodiments disclosed herein is illustrated. The material 70 may be solids or a mixture of solids and liquids. In an embodiment, the material 70 may be drill cuttings, LCM, drilling fluid, reservoir fluid, wellbore fluid, hydrocarbons and mixtures thereof. The LCM may be fibrous and/or plate-like in nature to form slurries to bridge over and/or seal loss zones associated with oilfield operations.

The collection trough 10 may be constructed from a generally rigid material, such as, for example, metal, plastic, composite and/or a combination of the same. The collection trough 10 may have a length, equal to and/or equivalent to a width of a deck of the vibratory separator 98 shown in FIG. 1 to, for example, accommodate insertion and/or placement of the collection trough 10 within the shale shaker as needed.

Figure 2:
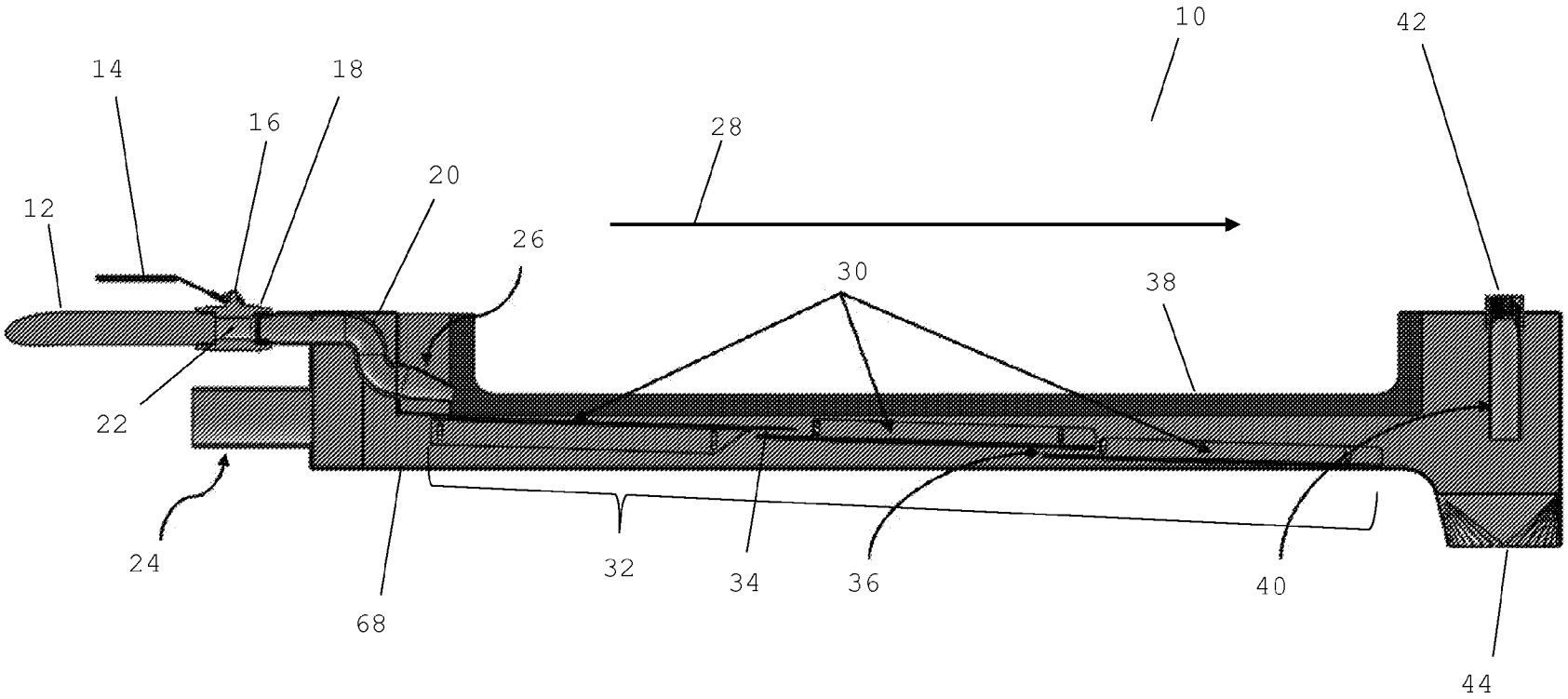
FIG. 2 illustrates a front section view of the trough depicting various nozzles in accordance with embodiments disclosed herein.

As described above, the collection trough 10 may collect the material 70 from the inlet 116 as shown in, for example, FIG. 1. Accordingly, solids and/or solid-liquid mixtures of the material 70 collected in the collection trough 10 may flow and/or be pumped, for example, from the collection trough 10 to other equipment. In an embodiment, due to the viscous and/or semi-viscous nature of the material 70, the material 70 may adhere to a wall 38 of the collection trough 10, for example, as shown in FIG. 2. Furthermore, the material 70 may not flow, move and/or convey across the distance of the collection trough 10 as intended.

A fluid 66 may flow and/or be provided through an inlet flush nozzle 26, as shown in, for example, FIG. 2, to lubricate tiered plates 30 attached to the walls 38 of the collection trough 10. The material 70 may fall and/or move from the inlet, as shown in FIG. 1, on the fluid 66. The flow of the fluid 66 may be increased, decreased, and/or otherwise regulated to allow for continuous movement across the tiered plates 30. Such continuous movement may lubricate surfaces that may be exposed to the falling materials, e.g. the tiered plates 30 and/or the walls 38 is shown. The tiered plates 20 may form a perforated surface 32 in an embodiment, as shown in various embodiments FIGS. 2, 6, 8 and 11-13, each embodiment of which will be further described below. The fluid 66 may be, for example, cleaned or screened drilling fluid, such as drilling fluid/wellbore fluid that has been screened by a vibratory separator, oil, such as pure base oil, water, or other liquid and/or any combination thereof and may thus form a relatively thin film on top of the tiered plates 30. Accordingly, the fluid 66 may have a lower viscosity than the material 70 and may thus flow with less resistance and/or at a greater rate across the tiered plates 30 of collection trough 10 in comparison to the material 70 alone. Further, the fluid 66 may decrease friction encountered between the material 70 and the tiered plates 30 and/or walls 38 of the collection trough 10 as the material 70 flows across the collection trough 10 in a direction of flow 28.

In an embodiment, the collection trough 10 may also be configured to receive the fluid 66 through a main inlet 24 attached to and/or opening to the collection trough 10 and/or an inlet flush nozzle 26. A width of the inlet flush nozzle 26 may be substantially equivalent to a width 58 of the collection trough 10 and/or a width of tiered plates 30 to uniformly coat and/or lubricate the tiered plates 30. As shown in FIG. 1, the material 70 may be redirected by a deflector plate 126, as shown in FIG. 1, into the collection trough 10.

As discussed above, the high viscosity of the material 70 (in an embodiment) can cause the material 70 to effectively adhere to areas, such as bridges and/or connectors, inside the collection trough 10. Application of a substance having a lower viscosity than that of the material 70, such as the fluid 66, may reduce friction encountered by the material 70 against the walls 38 of the collection trough 10 by preventing the material 70 from contacting the walls of the collection trough 10. For example, the fluid 66 may form an interstitial layer between the material 70 and, for example, a collection trough bottom 68, as shown in FIG. 5, and/or the walls 38 of the collection trough 10. In addition, the fluid 66 may flow and carry the material 70, which may rest on top of the fluid 66, toward an outlet 44 of the collection trough 10. At the outlet 44, a turbulent jet of the fluid 66 may mix with the material 70 to, for example, reduce the viscosity of the material 70, to allow the material 70 to flow more freely and be pumped to, for example, a storage location.

In an embodiment, the inlet flush nozzle 26 may be as wide as the collection trough 10 and/or the tiered plates 30. Further, a fluid film nozzle 36 may insert and/or distribute the fluid 66 on and/or between the tiered plates 30 as shown in FIG. 1. Also, the fluid film nozzle 36 may be placed and/or inserted at additional locations along and/or between the tiered plates 30. The tiered plates 30 may be arranged as, for example, a staircase, where each plate of the tiered plates may be positioned above a subsequent plate, separated by a gap 34 as shown in FIG. 2. The fluid 66 may flow across each of the tiered plates 30 to, for example, cascade and/or spill onto the next tiered plate 30, toward the outlet 44. Further, the main inlet 24 may also connect and/or couple to an entrance pipe 12 through a hose 46, as shown in FIG. 3, to allow for the fluid 66 to be pumped in to the main inlet 24 and through the entrance pipe 12 from an outside source and/or pipe (not shown). Thus, the fluid 66 may flow into the collection trough 10 from both the entrance pipe 12 as well as the main inlet 24 to coat the tiered plates 30 and/or to flood the collection trough 10, respectively.

A portion of the fluid 66 flowing through the main inlet 24 may flow through multiple additional fluid film nozzles 36, as shown in FIG. 2, placed across the collection trough 10. The flow of the fluid 66 may be adjusted via the placement and/or orientation of the inlet flush nozzle 26 and/or of the fluid film nozzles 36 to evenly distribute the fluid 66 across the width of the tiered plates 30 on the collection trough 10 to flow as a relatively thin film. The fluid 66 may enter the collection trough 10 through the main inlet 24 and, as described above, may also be simultaneously directed to the inlet flush nozzle 26 via the hose 46 as shown in FIG. 3. Flow of the fluid 66 through the inlet flush nozzle 26 may add to the velocity of the fluid 66 entering the collection trough 10 through the main inlet 24 that may allow and/or assist the fluid 66 to flow, for example, continuously across the tiered plates 30.

In an embodiment, a fluid film nozzle height 60, as shown in FIG. 4, may be adjusted by moving the tiered plates 30 in, for example, the vertical direction. Adjusting the fluid film nozzle height 60, along with the fluid 66 flow rate, may, in turn, adjust the height and/or depth of the fluid 66 relative to the tiered plates 30. The fluid film nozzle height 60 may thus be adjusted to accommodate various quantities of the material 70 to, for example, prevent the material 70 from contacting the walls of the collection trough 10. The material 70 may rest and/or float over the fluid 66, as shown in FIG. 5. The speed of the fluid 66 flowing across the tiered plates 30 may be adjusted as needed to move the material 70 toward the outlet 44. An outlet jet nozzle 42 positioned, for example, above the outlet 44, may force, provide and/or flow fluid 66 to contact or to mix with the material 70 to produce a resulting mixture of a lower viscosity. The resulting mixture of the fluid 66 and the material 70 can be pumped to a storage location or otherwise conveyed to a location. In an embodiment, the location of the outlet jet nozzle 42 may be moved further downstream of the collection trough 10. Also, an eductor (not shown) may also help move the material 70 and/or fluid 66 further down the outlet 44.

Figure 6:
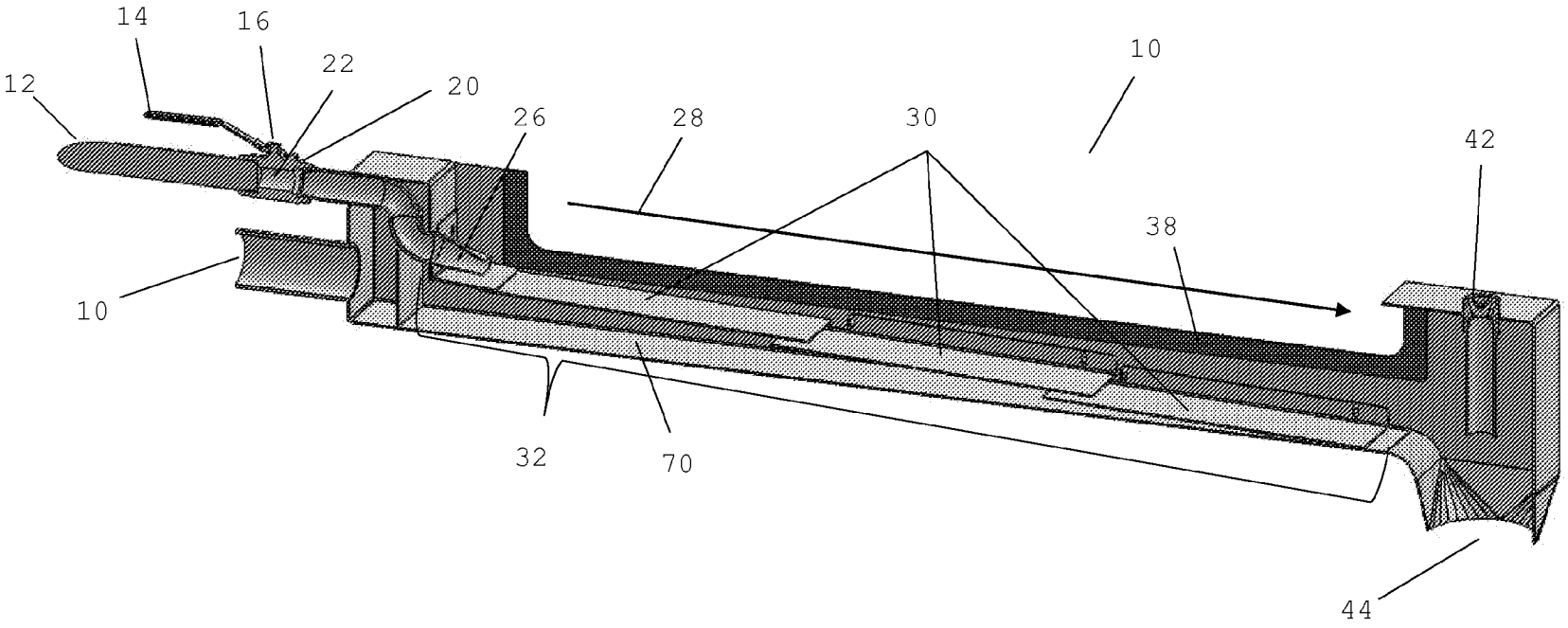
FIG. 6 illustrates an isometric section view of the trough in accordance with embodiments disclosed herein.
Figure 7:
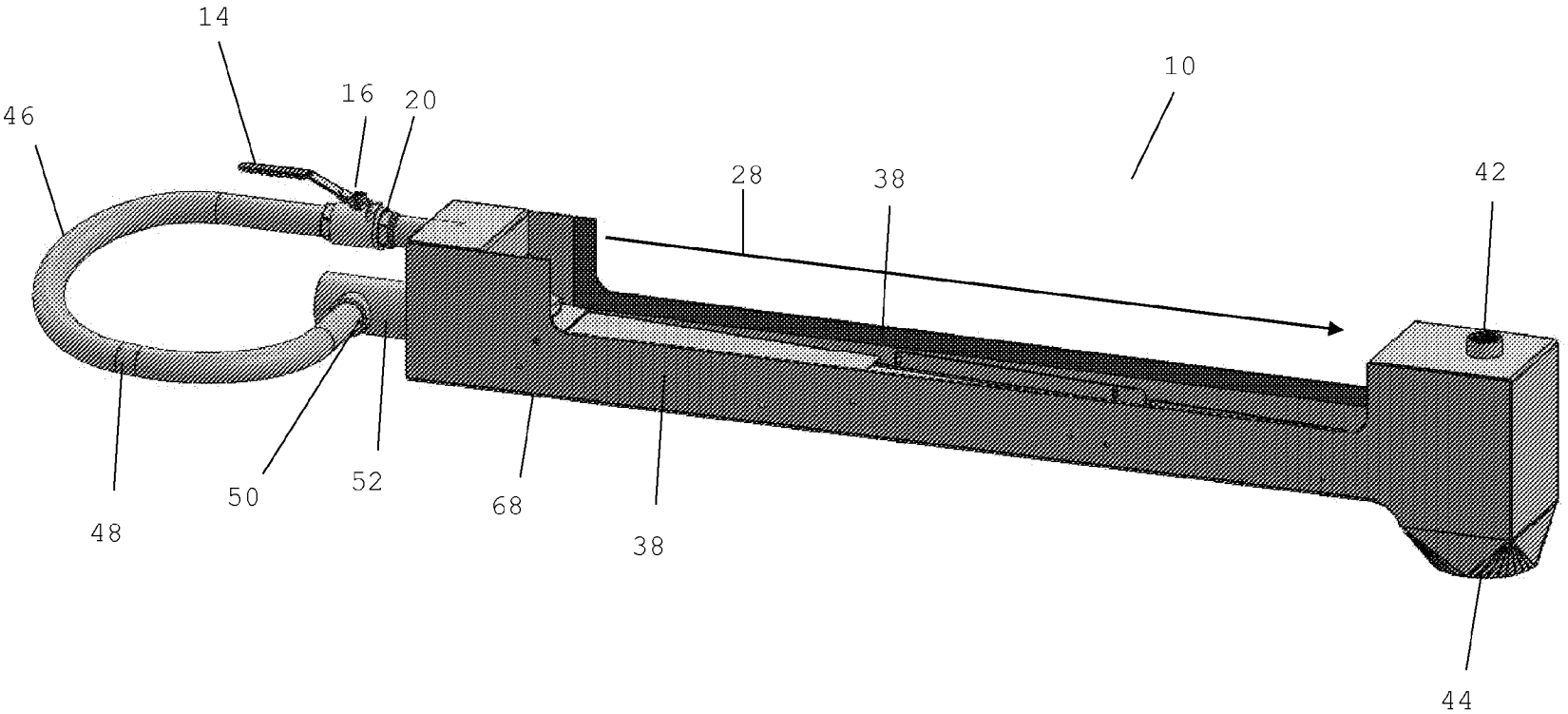
FIG. 7 illustrates an isometric view of the trough in accordance with embodiments disclosed herein.

In further detail, FIGS. 2 and 6 illustrate a sectional front and perspective view, respectively, of an embodiment of the collection trough 10 with the entrance pipe 12 connecting to an inlet flush nozzle delivery pipe 20 through a housing 18. A valve comprising a lever 14 may attach to a pivot 16 on the housing 18 to regulate the flow of the incoming fluid 66 through a chamber 22 that defines an interior of the housing 18. The housing 18 may connect the entrance pipe 12 to the inlet flush nozzle delivery pipe 20 that may bend, as shown in FIG. 1, to align with the inlet flush nozzle 26 as shown in FIGS. 1 and 3. In an embodiment, the inlet flush nozzle 26 may have a width substantially equivalent to the width of the tiered plates 30 to assist in coating and/or lubricating the tiered plates 30 and/or walls 38 with the fluid 66 that may pass through the inlet flush nozzle 26.

The main inlet 24 may attach and/or connect to the collection trough 10 as shown in FIG. 1 and may supply the fluid 66 in conjunction with the inlet flush nozzle 26, to provide a continuous flow of the fluid 66. Accumulation of the fluid 66 upon a collection trough bottom 68, as shown in FIGS. 1 and 3, from, for example, the main inlet 24, may cause the fluid 66 to rise through the gaps 34 and cover and/or coat the tiered plates 30.

The tiered plates 30 may be arranged in a series at an angle relative to the horizontal, as shown in FIGS. 2 and 6, to allow, for example, gravity to also pull the fluid 26 flowing from the inlet flush nozzle 26 in the direction of flow 28.

As shown in an embodiment illustrated by FIGS. 8 through 14, the perforated surface 32 may be installed in the collection trough 10 in place of the tiered plates 30 to also collect and/or accumulate the material 70 entering and/or falling from the second deck 96 of the vibratory separator 98 as shown in, for example, FIG. 1. In some embodiments, the tiered plates 30 may have perforations similar to the perforated surface 32. The material 70 may contact the fluid 66 to flow across the perforated surface 32 toward the outlet 44. The outlet jet nozzle 42 and an outlet jet nozzle column 40 provides fluid force to mix or otherwise move the material 70 with the fluid 66 into the outlet 44. The mixture of the fluid 66 and the material 70 may increase the ease of pumping and/or transferring the mixture through the outlet 44 to a remote location.

As illustrated in FIGS. 3 and 6, the collection trough 10 with the hose 46 is shown. The hose 46 may connect to the main inlet 24 at a seal 50. A connector 48 may attach to and/or reinforce the hose 46. A source and/or a pipe (not shown) may provide the fluid 66 to the main inlet 24. The hose 46 may direct or provide the fluid 66 to the entrance pipe 12. The lever 14 of the valve can regulate the quantity of the fluid 66 permitted to enter into the inlet flush nozzle 26 via the inlet flush nozzle delivery pipe 12 and the chamber 22. Mounting holes 54 may receive screws to attach and/or mount the tiered plates 30 at an angle relative to the horizontal as shown in FIG. 2, for example.

Referring now to FIG. 3, a side view sectional view of the collection trough 10 with the hose 46 is shown. The hose 46 may have an elbow 56. One or more fluid film nozzles 36 (not shown in FIG. 3) may attach to and/or insert into the collection trough 10 at various locations to assist in the regulation of a continuous flow of the fluid 66 across the adjustable bottom sections 32. As discussed above, the inlet flush nozzle 26 may have a fluid film nozzle width 58 substantially equal and/or equivalent to the width of the tiered plates 30 and/or the perforated surface 32 to deliver a uniform amount of the fluid 66. Further, the fluid film nozzle height 60 may be adjusted to accommodate, for example, different quantities and/or flow rates of the fluid 66 delivered through the inlet flush nozzle 26. In the embodiment shown in FIG. 3, the inlet flush nozzle 26 may extend to and/or conclude at an inlet flush nozzle tip 64.

As illustrated in FIG. 5, a schematic diagram depicting the material 70 as deposited and/or resting on top of the fluid 66 is shown. As described above, the material 70 may fall from the second deck 96 of the vibratory separator 98 to accumulate on the fluid 66, which may form an interstitial boundary layer between the collection trough bottom 68 and the material 70. Since the fluid 66 may have a lower viscosity than the material 70, the fluid 66 may be able to travel faster and/or with less difficulty than the material 70 alone along the collection trough bottom 68 in accordance with principles of fluid mechanics.

Generally, in the field of fluid mechanics, a Newtonian fluid is defined as a fluid in which the viscous stresses arising from flow of the Newtonian fluid, at every point, are linearly proportional to the local strain rate, i.e. the rate of change of deformation of the Newtonian fluid over time. Examples of common Newtonian fluids are water, oil, the fluid 66 and/or a combination thereof. Moreover, the approximation of a no-slip condition, in the field of fluid mechanics, for Newtonian viscous fluids states that at a solid boundary, such as the collection trough bottom 68, the fluid will have zero velocity relative to the boundary due to adhesive forces between the fluid and the boundary. In most circumstances, the viscosity of a fluid is a measure of its resistance to gradual deformation by shear stress or tensile stress.

The fluid 66 may have a lower viscosity than the material 70, which may include drilling fluid and/or various solids associated with, for example, oilfield operations. The lower viscosity of the fluid 66 may decrease the resistance to flow of the material 70. Thus, the fluid 66 may act as a lubricant to lubricate the collection trough bottom 68 and/or the walls 38 to increase the ability of the material 70 to move and be conveyed along the collection trough 10. Further, the fluid 66 can adhere to walls 38 of the trough 10 as shown in FIG. 1 to assist in the transfer of the material 70 across the collection trough 10.

Referring now to FIGS. 8-14, perforations 76 may be distributed across the perforated surface 32 to allow the fluid 66 to flow through the perforations 76, in all directions, to create a fluidized state. The material 70 may be suspended on the fluidized fluid 66. The fluidized state may help reduce friction between the material 70 and the collection trough bottom 68 to allow the material 70 to, for example, smoothly flow across the perforated surface 32.

In detail, the fluidized state may occur when, for example, a fixed bed of particulate material, such as the material 70, is penetrated in the vertical direction with the fluid 66 at a sufficient velocity to disengage, disrupt and/or move the bed. For example, gravitational forces pulling particulate material, such as the material 70, downward toward the earth may be counteracted and/or counterbalanced across the entirety of the perforated surface 32 in all directions at points where the fluid 66 flows upward and/or around to contact the particulate material. When a critical velocity, i.e. minimum fluidization velocity, is reached, the solid particles, such as the material 70, may start floating, moving chaotically and/or colliding. Mutual contacts between the particles, such as the particles found in the material 70, may be of short duration such that the forces between the particles may be weak. At that time, the particulate solid material, such as that found in the material 70, may be described to be in the fluidized state. In the fluidized state, particles may be in constant, chaotic movement where the mean distance between particles may increase with rising fluid velocity to, in turn, cause the particulate bed height to rise. A drop in pressure of the fluid phase across the bed may be constant and equal to the particle bed weight over a unit surface of the bed to suspend the particle bed.

In an embodiment, suspension of the particle bed may be achieved at the minimum, i.e. incipient, fluidization velocity. Further, when the bed may be fluidized with liquid, such as the fluid 66, the fluidization may be characterized as uniform and/or homogenous fluidization. The material 70 may be suspended and/or floating over the perforated surface 32. An impact velocity of the fluid 66 flowing through the perforations in the perforated surface 32 may, for example, suspend, float and/or carry the material 70 in the collection trough 10 toward the outlet 44.

Figure 8:
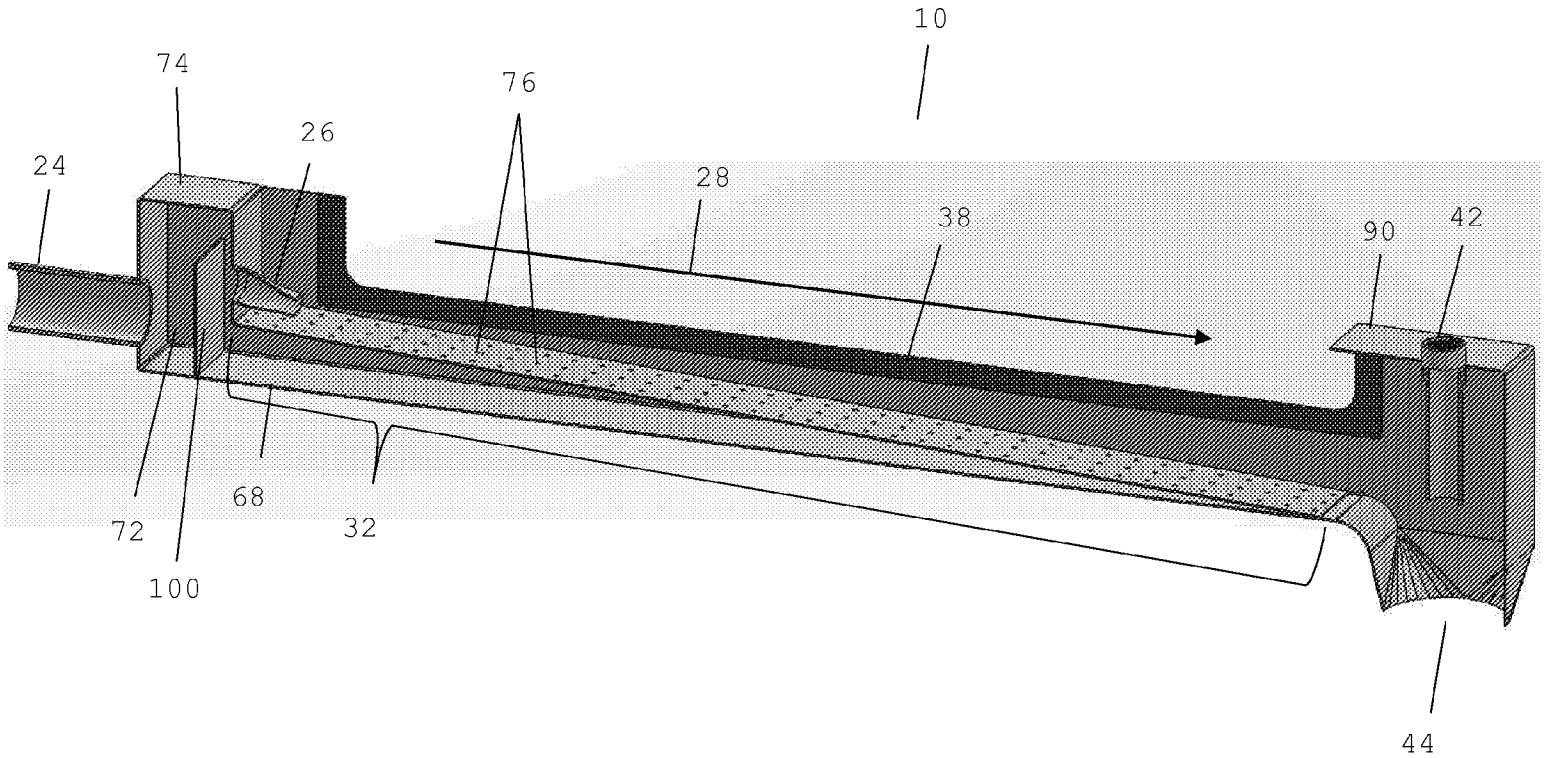
FIG. 8 illustrates an isometric section view of the trough with perforations in accordance with embodiments disclosed herein.
Figure 9:
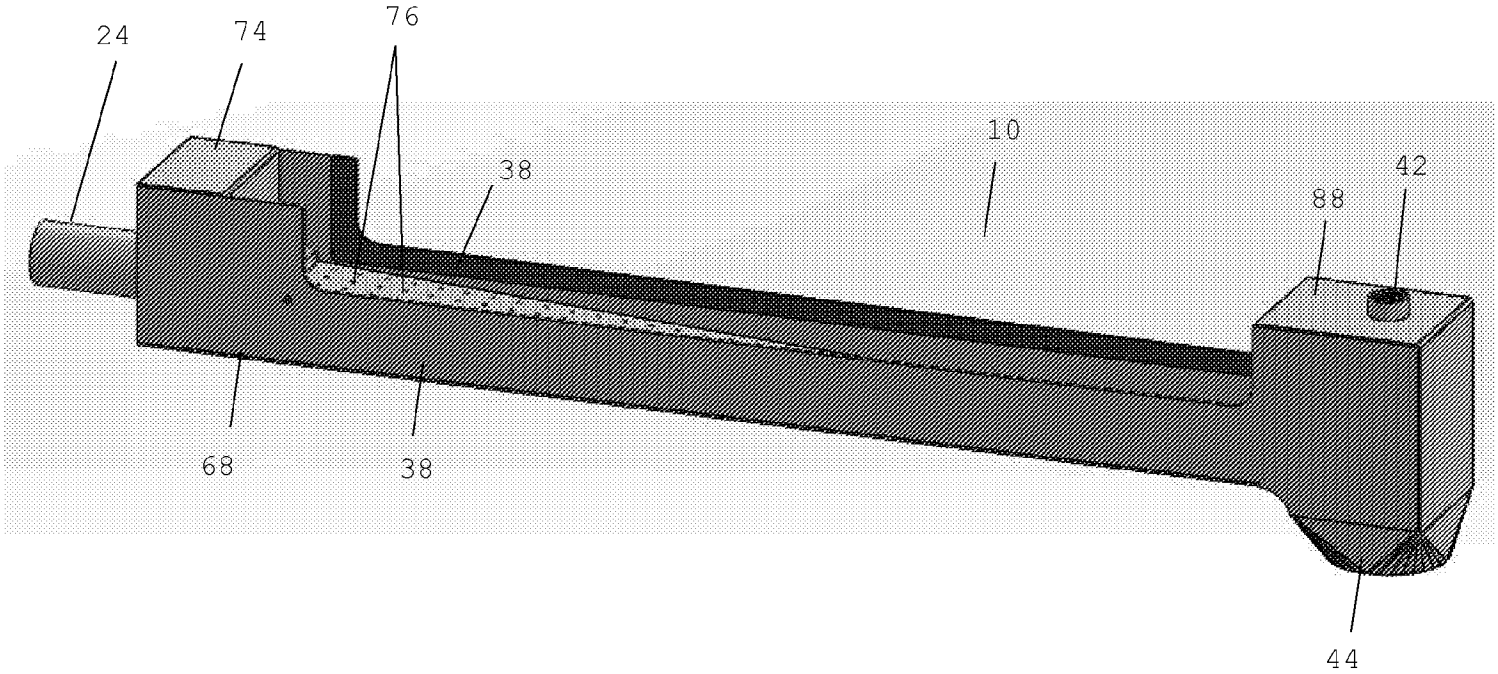
FIG. 9 illustrates an isometric view of the trough with perforations in accordance with embodiments disclosed herein.
Figure 11:
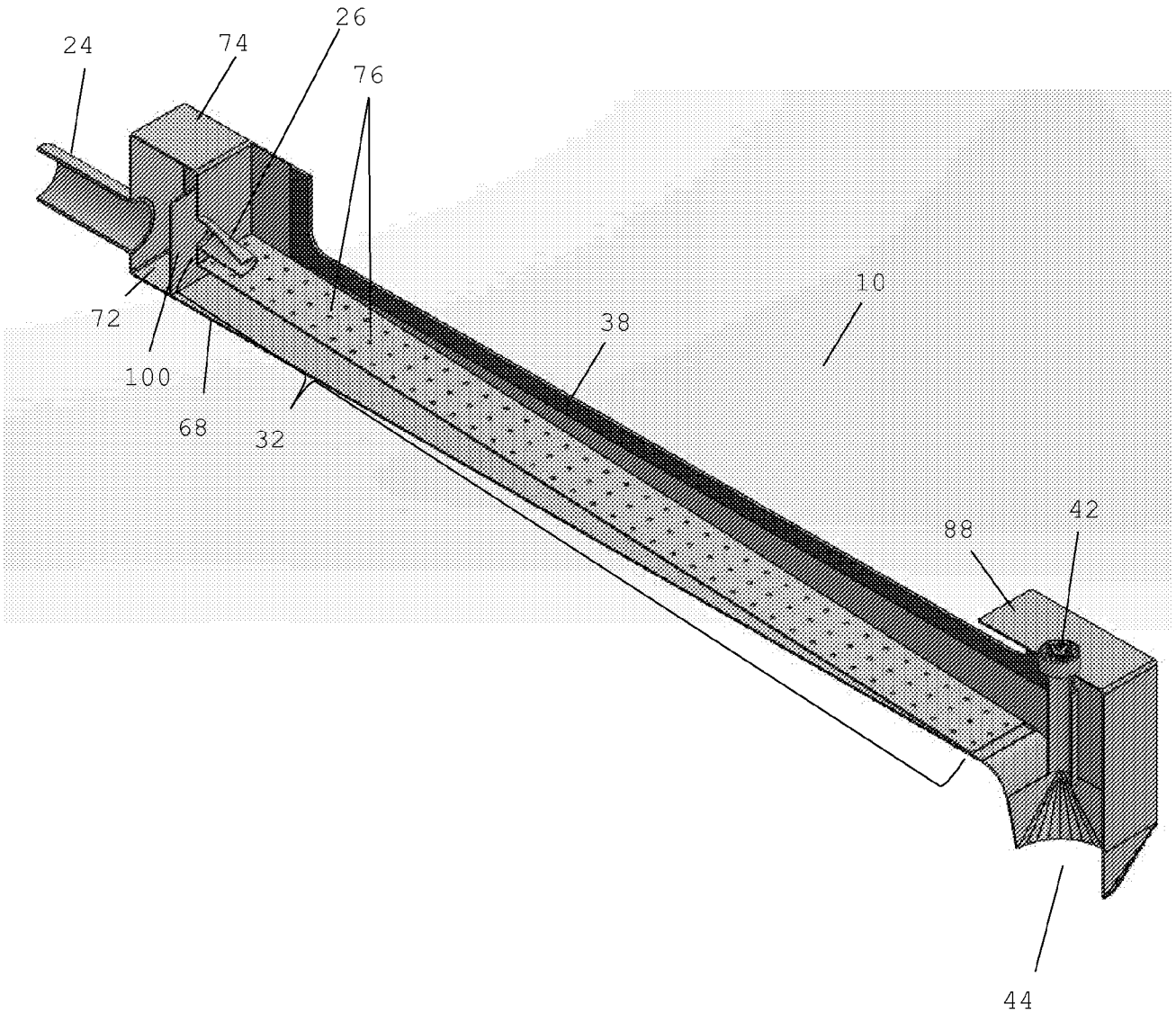
FIG. 11 illustrates a perspective section view of the trough with perforations in accordance with embodiments disclosed herein.
Figure 13:
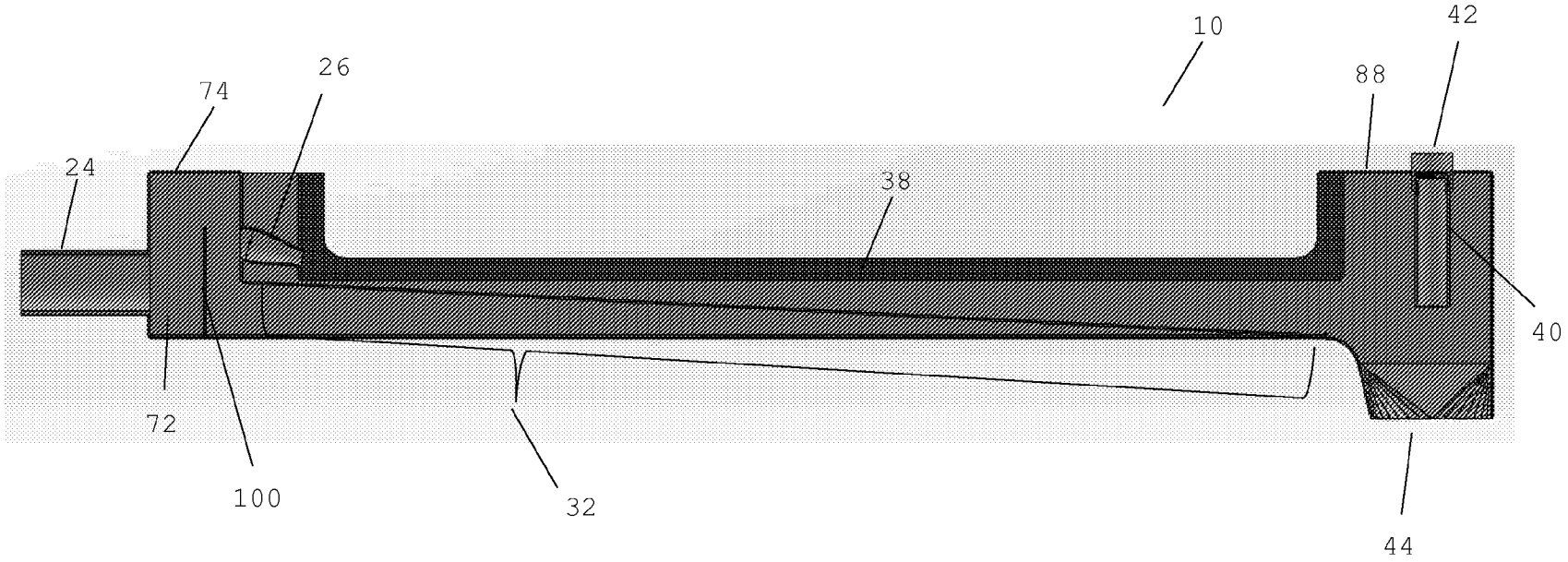
FIG. 13 illustrates a front view of the trough with perforations in accordance with embodiments disclosed herein.
Figure 14:
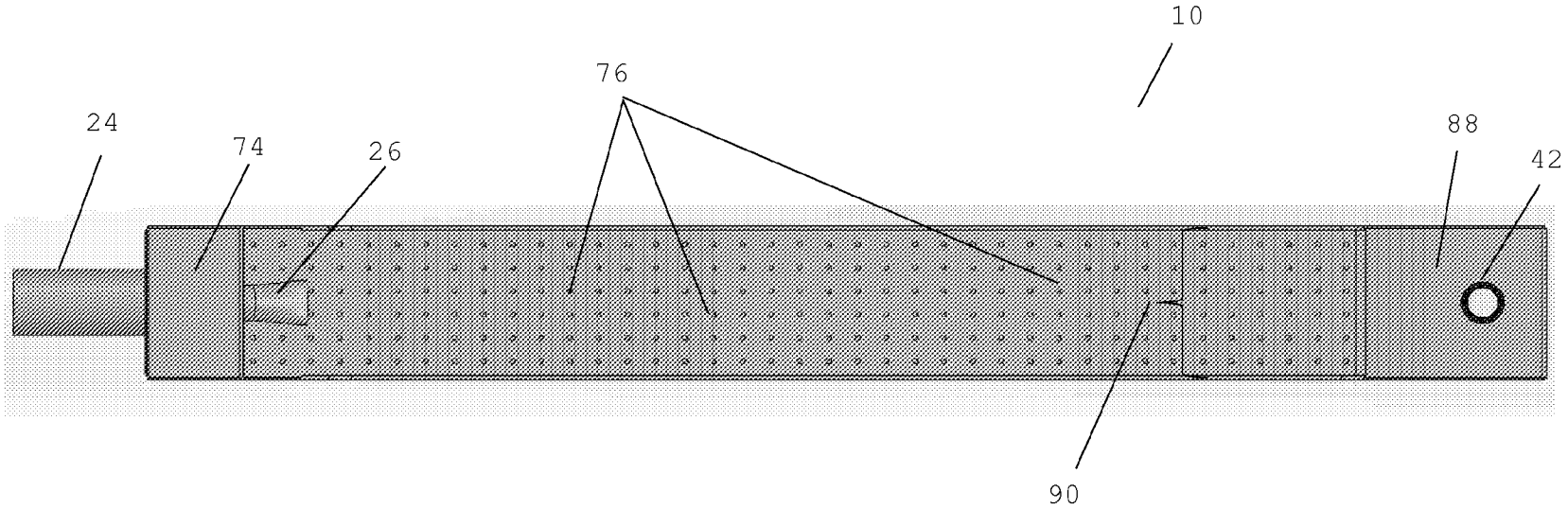
FIG. 14 illustrates a top view of the trough with perforations in accordance with embodiments disclosed herein.

In an embodiment, the collection trough 10 may have an intermediate mixing chamber 72, as shown in FIGS. 8, 11 and 13. The fluid 66 may enter through the main inlet 24 to contact and/or navigate around a redirection wall 100 to accumulate in the collection trough 10 and move, for example, upward through the perforations 76 to cover and/or coat a surface of the perforated surface 32. A first top surface 74 may close the intermediate chamber 72. Also, the fluid 66 may flood the intermediate mixing chamber 72 to spill over and pass through inlet flush nozzle 26 to coat and/or cover the perforated surface 32. The collection trough 10 may also have one or more of water, oil, fluid 60, mud, and/or the like flow through inlet nozzles (not shown) with valves and/or flow meters to flush, move or otherwise convey the material 70 into the outlet 44. Further, the collection trough 10 may have a discharge pipe (not shown) that may be equipped with an eductor and/or an additional injecting fluid nozzle (not shown).

Moreover, in an embodiment, the perforated surface 32 may be characterized as having a specified total number of holes, such as, for example, one hundred and fifty holes with a diameter of five millimeters per hole, i.e. approximately 0.2 inches. The disclosure is not limited to any specific number of holes and a person having ordinary skill in the art will appreciate that the number of holes may be modified due to the application and properties of fluids contacting the perforated surface 32. A flow rate of the fluid 66, the material 70, other solids, liquids and/or solid-liquid mixtures through the perforated surface 32 may be, for example, fifty gallons per minute at a pressure of ten pounds per square inch. Also, the perforated surface 32 may be flushed and/or cleaned by a flush fluid, mud and/or the like at a flow rate of one hundred and fifty gallons per minute.

Referring now to FIGS. 8-14, in an embodiment, the material 70, along with any cuttings associated with the material 70, may drop from the second deck 96 of the vibratory separator 98, as shown in FIG. 1, to enter the collection trough 10 and to form a layer of the material 70 atop the fluid 66 to travel toward the outlet 44 in the direction of flow 28. The material 70 may be flushed at the outlet 44 by a jet of the fluid 66, mud and/or the like delivered through the outlet jet nozzle 42. The fluid 66 may rise from the collection trough bottom 68 to penetrate, and/or "bubble" through the perforations 76 on the perforated surface 32 and/or to coat the walls 38. In an embodiment, the "bubbling" of the fluid 66 may be in a controlled manner to avoid, for example, applying excessive force to particulate matter associated with the material 70.

Fluidization and/or suspension of the material 70 above the perforated surface 32 may result from the fluid 66 accumulating and/or fluidly pressurizing the collection trough 10 and penetrating or otherwise moving through the perforations 76 to produce, for example, an "air hockey" table-type fluidization, i.e. where compressed air flows upwards through holes in an air hockey game table to fluidize the surface to reduce friction between a puck and the surface.

Force of the fluid 66 entering from the inlet flush nozzle 26 may combine with the "air-hockey" table-type fluidization of the perforated surface 32 to help flow the material 70 toward the outlet 44. A discharge pipe (not shown) may be, for example, six inches in diameter, and attach to the outlet 44 to further transfer the material 70.

In an embodiment, the outlet 44 may have a larger opening before necking down (not shown) to a smaller pipe. The necking may improve draining, prevent accumulation and/or backing up of the material 70 and/or other materials in and/or near the outlet 44. The outlet jet nozzle 42, or other nozzles (not shown), may be located on a second top surface 88 and assist in draining the material 70 from the collection trough 10. Further, the collection trough 10 may be configured to operate as described above without additional power and/or pneumatic sources. One or more inlet nozzles, such as the main inlet 24 and/or the inlet flush nozzle 26, may be equipped with valves (not shown) to adjust fluidization and/or flushing flow into and/or through the collection trough 10.

In an embodiment, air bubbles may be interspersed with the fluid 66 to increase the fluidization and/or lifting of the material 70 over the perforated surface 32. Further, the number of perforations 76 in the perforated surface 32 may be increased and/or decreased as needed, based on, for example, pressure drop, fluidization and solids content in the material 70. Also, an additional fluid injecting source (not shown) may be located at a discharge pipe (not shown) attached to the outlet 44 to enable the mixture of the material 70 and the fluid 66 to transfer to another location such as an active tank (not shown).

Figure 10:
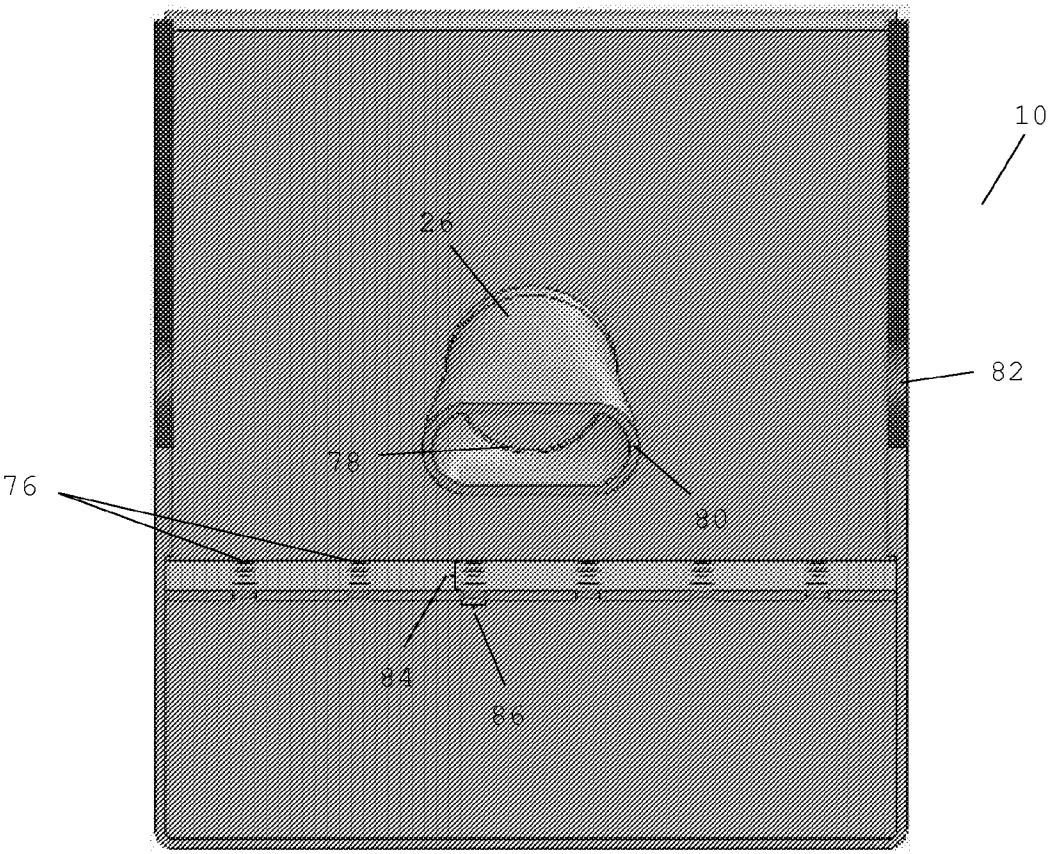
FIG. 10 illustrates a side section view of the trough with perforations in accordance with embodiments disclosed herein.

Referring now to FIG. 10, a side view of the collection trough 10 is shown. The perforated surface 32 may have perforations 76 with a defined height 84 and depth 86. In an embodiment, the inlet flush nozzle 26 may extend to a tapered exit port 80 and may be attached to the collection trough 10 by a weld 78.

Figure 12:
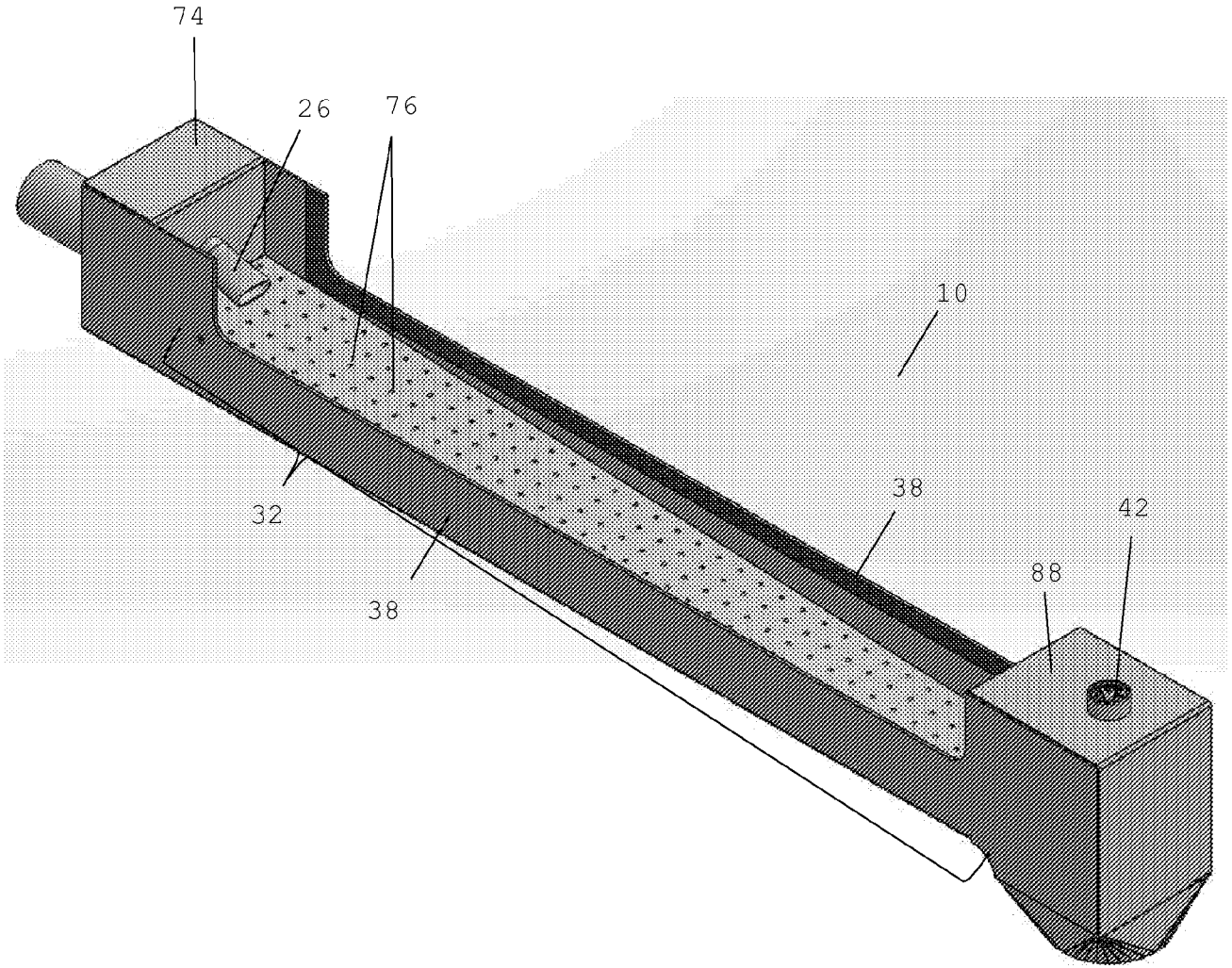
FIG. 12 illustrates perspective view of the trough with perforations in accordance with embodiments disclosed herein.

As illustrated in FIG. 12, a front section view of the collection trough 10 is shown. The perforated surface 32 may be positioned at an angle relative to the horizontal and/or the collection trough bottom 68 to use gravitational forces, for example, to assist in transfer of the material 60 across the collection trough 10.

Referring now to FIG. 13, a front view of the collection trough 10 with the perforated surface 32 is shown. The perforations 76 may be located intermittently throughout the perforated surface 32. Further the perforated surface 32 may have a defined width 90.

Although only a few example embodiments have been described in detail above, those skilled in the art will readily appreciate that many modifications are possible in the example embodiments without materially departing from scope of embodiments described herein. Accordingly, all such modifications are intended to be included within the scope of this disclosure.

What is claimed is:

1. A collection trough for a vibratory separator, comprising:

a body comprising:

an inlet end;

an outlet end distanced a length from the inlet end; and at least one vertical wall traversing from the inlet end to the outlet end, wherein the inlet end comprises an inlet and an inlet nozzle that are configured to flow fluid across the body towards the outlet end of the body, the outlet end comprises an outlet, at least one plate is positioned in the body and extends along the length of the body to direct material from the inlet end to the outlet end, a first fluid entrance into the body is provided by the inlet nozzle and configured to flow fluid towards the outlet of the outlet end, a second fluid entrance into the body is provided by the inlet and configured to flow fluid towards the outlet of the outlet end, the first fluid entrance is above the at least one plate, and the second fluid entrance is below the at least one plate.

2. The apparatus of claim 1, wherein the outlet end also comprises an outlet nozzle opposite the outlet.

3. The apparatus of claim 1, wherein the at least one plate is vertically adjustable to be at an angle relative to horizontal.

4. The apparatus of claim 1, wherein the body further comprises a bottom wall and the inlet end further comprises a redirection wall spaced a distance from the inlet and attached perpendicularly to the bottom wall.

5. The apparatus of claim 1, wherein the at least one plate comprises a plurality of perforations.

6. The apparatus of claim 1, wherein the at least one plate comprises a plurality of plates, wherein each plate may be positioned above a subsequent plate and each plate is separated by a gap.

7. The apparatus of claim 6, further comprising a plurality of film nozzles located a height above the plurality of plates.

8. The apparatus of claim 7, wherein the height above the plurality of plates is adjustable.

9. The apparatus of claim 1, wherein the width of the inlet nozzle is equivalent to the width of the at least one plate.

10. The apparatus of claim 1, further comprising an eductor.

11. A method comprising:

providing a flow of drilling fluid from a wellbore to a vibratory separator;

separating the drilling fluid into a first effluent and a second effluent, the second effluent including solids larger than openings in a screen in the vibratory separator;

transferring the second effluent from the vibratory separator to a collection trough having at least one plate positioned therein and traversing along the length of the collection trough;

providing a flow of fluid having a lower viscosity than the second effluent to an inlet end of the collection trough to assist the transfer of the material and separating the flow of fluid into a first fluid flow above the at least one plate and a second fluid flow below the at least one plate, wherein the first fluid flow is directed through at least one nozzle located at the inlet end and above the at least one plate, and wherein the second fluid flow is directed through an inlet located at the inlet end and below the at least one plate, wherein the second fluid flow moves upward through the at least one plate; and collecting the second effluent and fluid from at an outlet end of the collection trough.

12. The method of claim 11, wherein the providing the flow of fluid comprises preventing the second effluent from adhering to the collection trough.

13. The method of claim 12, wherein the providing the flow of fluid comprises continuously flowing the fluid through the collection trough.

14. The method of claim 11, further comprising providing a flow of fluid to an outlet nozzle in the collection trough.

15. A system comprising:

a vibratory separator comprising at least one deck;

a collection trough coupled to the at least one deck comprising:

an inlet end having an inlet and an inlet nozzle;

an outlet end having an outlet;

a length from the inlet end to the outlet end equivalent to a width of the at least one deck; and at least one plate traversing the length from the inlet end to the outlet end; and a fluid source coupled to the inlet end of the collection trough to supply a fluid to a first fluid entrance provided by the inlet nozzle above the at least one plate and a second fluid entrance provided by the inlet below the at least one plate.

16. The system of claim 15, further comprising a distributor to control the flow of fluid to the inlet nozzle and the inlet.

* * * * *